US006331868B1

(12) United States Patent
Yamade et al.

(10) Patent No.: US 6,331,868 B1
(45) Date of Patent: Dec. 18, 2001

(54) THERMAL PRINTHEAD AND METHOD OF MAKING THE SAME

(75) Inventors: Takumi Yamade; Hiroaki Hayashi; Teruhisa Sako, all of Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 09/673,375

(22) PCT Filed: Feb. 2, 2000

(86) PCT No.: PCT/JP00/00579

§ 371 Date: Oct. 16, 2000

§ 102(e) Date: Oct. 16, 2000

(87) PCT Pub. No.: WO00/48839

PCT Pub. Date: Aug. 24, 2000

(30) Foreign Application Priority Data

Feb. 18, 1999 (JP) ..... 11-039577

(51) Int. Cl.[7] ..... B41J 2/335
(52) U.S. Cl. ..... 347/208
(58) Field of Search ..... 347/200, 208; 29/611

(56) References Cited

FOREIGN PATENT DOCUMENTS 1-255565 10/1989 (JP) ..... B41J/3/20
3-227662 10/1991 (JP) ..... B41J/2/345
4-19155 * 1/1992 (JP) ..... 347/208

* cited by examiner

*Primary Examiner*—Huan Tran
(74) *Attorney, Agent, or Firm*—Michael D. Bednarek; Shaw Pittman LLP

(57) ABSTRACT

A thermal printhead (A) includes an insulating substrate (10) having an upper surface (10*a*) and a side surface (10*b*), and a heat retaining glaze layer (11) formed on the substrate (10). A heating resistor (13) is formed on the glaze layer (11). The thermal printhead (A) further includes a common electrode (12) and a plurality of individual electrodes. The common electrode (12) has a plurality of teeth (12*a*) connected to the heating resistor (13), and a connecting portion (12*b*) which connects the teeth (12*a*) with each other. An electrode auxiliary layer (14) is formed on the connecting portion (12*b*). The heating resistor (13) and the electrode auxiliary layer (14) are covered with an overcoat layer (16) which is, in turn, covered with a protective layer (17). The connecting portion (12*b*) of the common electrode (12) directly contacts both the glaze layer (11) and the upper surface (10*a*) of the substrate.

18 Claims, 6 Drawing Sheets

THERMAL PRINTHEAD AND METHOD OF MAKING THE SAME

TECHNICAL FIELD

The present invention relates to a thermal printhead, or specifically a thick-film thermal printhead. It also relates to a method of making such a thermal printhead.

BACKGROUND ART

As is well known, a thick-film thermal printhead has a heating resistor and an electrode pattern (including a common electrode and individual electrodes) formed by printing and baking a conductive paste. FIG. 11 of the accompanying drawings is a sectional view showing an example of prior art thermal printhead. The illustrated thermal printhead B includes a substrate 100 which is provided, entirely on the upper surface thereof, with a glaze layer 110 for heat retention. A common electrode 120 and a plurality of individual electrodes (not shown) are formed on the glaze layer 110. The thermal printhead B further includes a heating resistor 130 electrically connected to the common electrode 120 and the individual electrodes.

An common electrode auxiliary layer 140 is formed on the common electrode 120 at a portion spaced from the heating resistor 130. The common electrode auxiliary layer 140 is provided for preventing a voltage drop in the common electrode 120.

The thermal printhead B has an overcoat layer 150 for covering the common electrode 120, non-illustrated individual electrodes, the heating resistor 130 and the common electrode auxiliary layer 140. Further, a protective layer 160 which is thinner than the overcoat layer 150 is formed on the overcoat layer 150. The protective layer 160 is formed of a material which is less susceptible to wear and scratches than the material for the overcoat layer 150. With such a structure, the common electrode 120 and other parts are prevented from directly contacting a recording paper S. As shown in FIG. 11, the protective layer 160 is formed not only on the upper surface of the overcoat layer 150 but also continuously on a side surface 100*s* of the substrate 100.

As shown in FIG. 11, a platen roller C is provided on the thermal printhead B so as to contact the protective layer 160. The platen roller C rotates in the direction of the arrow D1 to transfer the recording paper S in the direction of the arrow D2 in close contact with the protective layer 160. At this time, the recording paper S transferred outwardly by the platen roller C warps downwardly by its own weight. The substrate 100 and the glaze layer 110 are chamfered in such a manner as to correspond to such a warp. As a result, the substrate 100 is formed with a first bevel portion 100*a*, whereas the glaze layer 110 is formed with a second bevel portion 110*a*. Accordingly, it is possible to prevent the recording paper S from being caught at a corner of the substrate 100 (or of the glaze layer 110), and therefore, it is possible to transfer the recording paper S smoothly outwardly by the platen roller While having the advantages described above, the prior art thermal printhead B has the following problems.

First, due to the difference in thermal expansion coefficient between the glaze layer 110 and the protective layer 160, the protective layer 160 in the form of a thin film may break or may be released from the glaze layer 110. Specifically, the protective layer 160 directly covers the glaze layer 110 at a portion of the upper surface and continuously at the inclined portion 110*a*. When the glaze layer 110 and the protective layer 160 are heated, they thermally expand to different degrees with each other. As a result, stress is concentrated on the ridge 160*a* of the protective layer 160, resulting in the breakage of the protective layer 160.

Secondly, with the structure of the prior art thermal printhead B, it is impossible to sufficiently urge the recording paper S toward the heating resistor 130, which may cause improper printing. As shown in FIG. 11, the protective layer 160 has a first convex portion 160*b* (a portion above the heating resistor 130) and a second convex portion 160*c* (a portion above the common electrode auxiliary layer 140), with both of which convex portions the platen roller C engages. However, because of the existence of the common electrode auxiliary layer 140, the second convex portion 160*c* is located considerably higher than the first convex portion 160*b* (See the sign "t" in the drawing). With such a structure, the pressing force by the platen roller C is mostly exerted on the second convex portion 160*c*, so that the recording paper S is not sufficiently pressed against the first convex portion 160*b*. As a result, heat from the heating resistor 130 is not sufficiently transmitted to the recording paper S, which may cause printing failure such as unclear printing results.

DISCLOSURE OF THE INVENTION

The present invention, which is conceived under the circumstances described above, aims to provide a thermal printhead which is capable of preventing a thin film protective layer on a bevel surface of a substrate from being peeled off or broken and which is capable of performing printing at suitable density.

Another object of the present invention is to provide a method of making such a thermal printhead.

In accordance with a first aspect of the present invention, there is provided a thermal printhead comprising: an insulating substrate having an upper surface and a side surface; a glaze layer for heat retention formed on the upper surface of the substrate; a heating resistor formed on the glaze layer; a common electrode having a plurality of teeth in connected to the heating resistor, and a connecting portion connecting the teeth with each other; a plurality of individual electrodes connected to the heating resistor; an electrode auxiliary layer formed on the connecting portion of the common electrode; an overcoat layer for covering the heating resistor and the electrode auxiliary layer; and a protective layer for covering the overcoat layer; wherein the connecting portion of the common electrode includes a first region contacting the glaze layer and a second region contacting the upper surface of the substrate.

Preferably, the electrode auxiliary layer contacts both the first region and the second region of the connecting portion.

Preferably, the electrode auxiliary layer includes a thinner portion contacting the first region of the connecting portion and a thicker portion contacting the second region of the connecting portion.

According to a preferred embodiment of the present invention, the protective layer includes a first protrusion positionally corresponding to the heating resistor and a second protrusion positionally corresponding to the thinner portion of the electrode auxiliary layer. The first and the second protrusions are substantially equal in height.

Preferably, the glaze layer includes an uneven portion contacting the first region of the connecting portion, and the uneven portion is tapered toward the side surface of the substrate.

According to a preferred embodiment of the present invention, the substrate has a bevel surface extending between the upper surface and the side surface of the substrate.

Preferably, the glaze layer is spaced from the bevel surface.

Preferably, the bevel surface is covered with a protective layer.

Preferably, the bevel surface is roughened.

In accordance with a second aspect of the present invention, there is provided a method of making a thermal printhead which comprises an insulating substrate having an upper surface and a second surface adjoining the upper surface; a heat retaining glaze layer formed on the upper surface of the substrate; a heating resistor formed on the glaze layer; an electrode pattern connected to the heating resistor; an electrode auxiliary layer formed on the electrode pattern; an overcoat layer for covering the heating resistor and the electrode auxiliary layer; and a protective layer formed on the overcoat layer. The method comprises the steps of: forming the glaze layer to be spaced from the second surface of a substrate; forming the electrode pattern to have a first region contacting the glaze layer and a second region contacting the upper surface of the substrate; forming the electrode auxiliary layer so as to contact both the first region and the second region of the electrode pattern; forming the overcoat layer to be spaced from the second surface of the substrate; and forming the protective layer to cover the overcoat layer and the second surface of the substrate.

Preferably, the glaze layer is formed to have an uneven portion tapered toward the second surface of the substrate, and the first region of the electrode pattern is formed to contact the uneven portion.

According to a preferred embodiment of the present invention, the step of forming the electrode auxiliary layer includes applying a fluid conductive paste onto both the first and the second regions of the electrode pattern.

Preferably, the conductive paste is allowed to flow from the first region to the second region.

Preferably, the second surface of the substrate is a bevel surface extending between the upper surface and a side surface of the substrate.

Preferably, the method further comprises the step of working the substrate to provide a bevel surface.

In accordance with a third aspect of the present invention, there is provided a method of making a thermal printhead. The method comprises the steps of forming a glaze layer on an insulating support; forming an electrode pattern to have a first region contacting the glaze layer and a second region contacting an upper surface of the support; forming an electrode auxiliary layer to contact both the first region and the second region of the electrode pattern; cutting the support at a position spaced from the electrode pattern and the electrode auxiliary layer; chamfering the support to have a bevel surface which is spaced from the electrode pattern and the electrode auxiliary layer; forming an overcoat layer to be spaced from the bevel surface for covering the glaze layer, the electrode pattern and the electrode auxiliary layer; and forming a protective layer for covering the overcoat layer and the bevel surface.

According to a preferred embodiment of the present invention, the method further comprises the step of applying laser to the support from below to form a cutting guide groove for cutting the support.

Preferably, the protective film is formed of a material containing sialon.

Other features and advantages of the present invention will become clearer from the detailed description given below with reference to the accompanying drawings.

BEST MODE FOR CARRYING OUT THE INVENTION

Preferred embodiments of the present invention will be described below in detail with reference to FIGS. 1 through 10.

Figure 1:
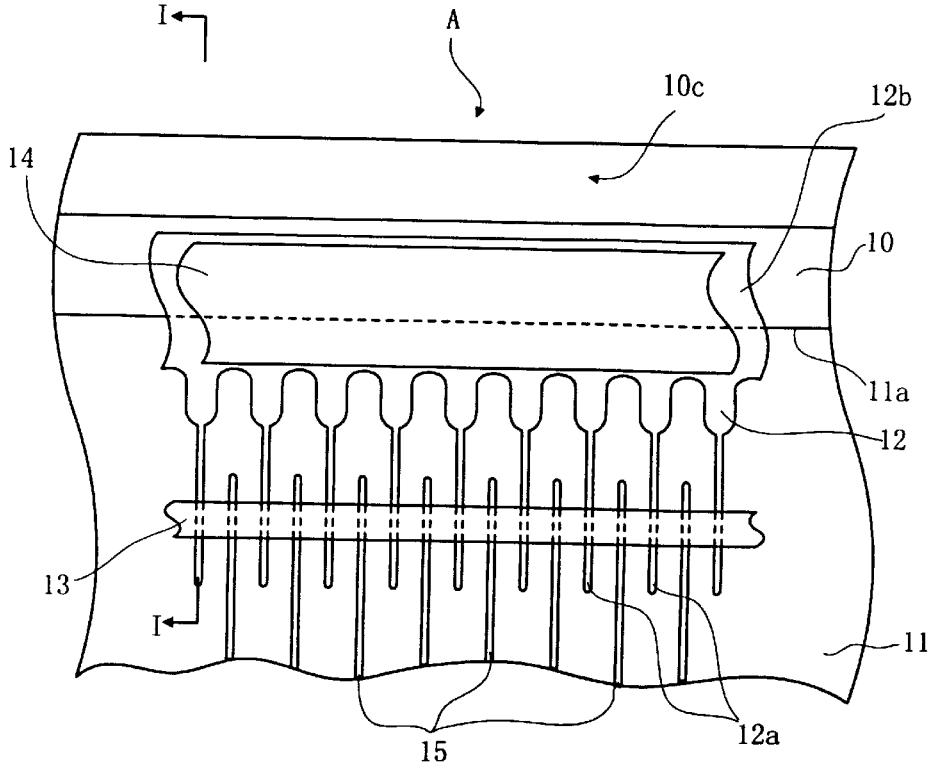
FIG. 1 is a plan view showing a principal portion of a thermal printhead embodying the present invention.
Figure 2:
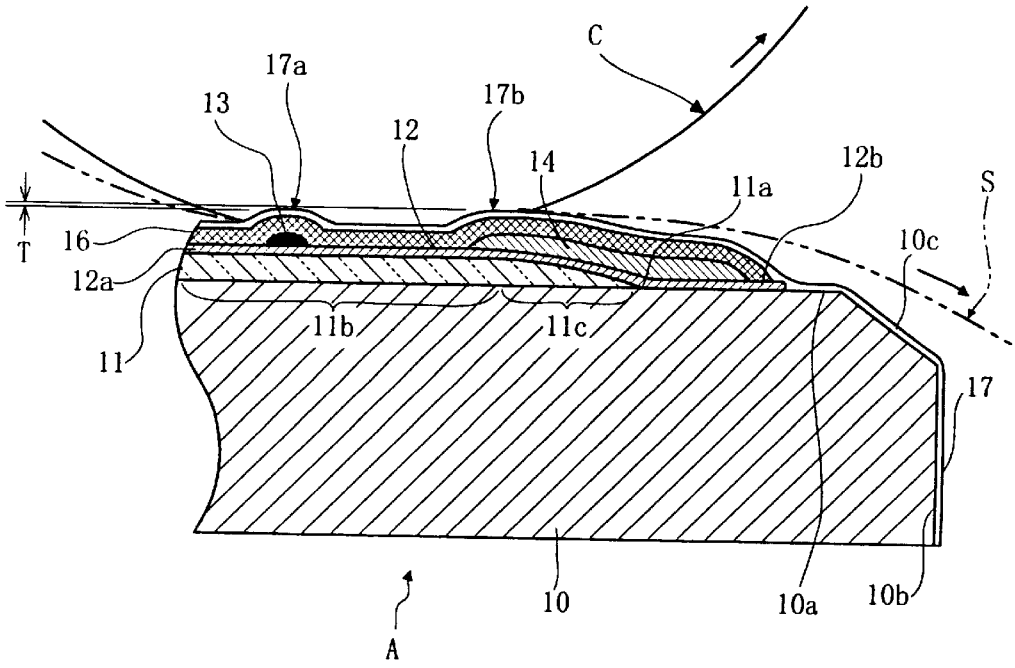
FIG. 2 is a sectional view taken along lines I—I in FIG. 1.

As shown in FIGS. 1 and 2, a thermal printhead A in accordance with the present invention includes an insulating substrate 10, a glaze layer 11 for heat retention, a common electrode 12, a heating resistor 13, a common electrode auxiliary layer 14, a plurality of individual electrodes 15, an overcoat layer 16, and a protective layer 17. The thermal printhead A, which is held in close contact with a platen roller C (FIG. 2), is incorporated in a printing apparatus.

The substrate 10 may be formed of a ceramic material for example. Though not illustrated in FIGS. 1 and 2, the substrate has an elongated, substantially rectangular configuration. The heating resistor 13 extends longitudinally of the substrate 10. As shown in FIG. 2, the substrate 10 has an upper surface 10*a* and a side surface 10*b*. The corner defined by the upper surface 10*a* and the side surface 10*b* of the substrate 10 is chamfered to provide a bevel surface 10*c* for transition from the upper surface 10*a* to the side surface 10*b* of the substrate 10. Preferably, the bevel surface 10*c* is roughened.

As shown in FIG. 2, the glaze layer 11 is formed directly on the upper surface 10*a* of the substrate 10. Further, as shown in FIG. 1, the glaze layer 11 has an edge 11*a* extending in parallel to the heating resistor 13. The edge 11*a* is spaced from the bevel surface 10*c* of the substrate 10. As is clear from FIG. 2, the glaze layer 11 comprises an even portion 11*b* having a constant thickness and an uneven portion 11*c* which varies in thickness. The uneven portion 11*c* tapers toward the edge 11*a*.

The common electrode 12 (to be exact, a portion of the common electrode 12) and the individual electrodes 15 are formed on the glaze layer 11. As shown in FIG. 1, the common electrode 12 has a plurality of teeth 12*a*, and a connecting portion 12*b* connecting these teeth together. The teeth 12*a* of the common electrode 12 and the individual electrodes 15 are alternately disposed. The teeth 12*a* and the individual electrodes 15 extend transversely of the heating resistor 13. The heating resistor 13 extends over each tooth 12*a* and one end of each individual electrode 15 in electrical connection thereto. Though not illustrated, the other end of each individual electrode 15 is electrically connected to a corresponding output pad of a drive IC.

As can be seen from FIGS. 1 and 2, the connecting portion 12*b* of the common electrode 12 is so formed as to directly contact both the glaze layer 11 and the substrate 10. Specifically, the connecting portion 12*b* includes a first region directly contacting the glaze layer 11, and a second region directly contacting the upper surface of the substrate 10. The connecting portion 12*b* does not reach the bevel surface 10*c* of the substrate 10. Specifically, the connecting portion 12*b* extends on the uneven portion 11*c* of the glaze layer 11 toward the bevel surface 10*c* of the substrate 10, but terminates between the edge 11*a* of the glaze layer 11 and the bevel surface 10*c*.

The common electrode auxiliary layer 14 is elongated similarly to the heating resistor 13 and attached to the connecting portion 12*b* of the common electrode 12. The common electrode auxiliary layer 14 is provided for reducing a voltage drop in the common electrode 12. Similarly to the connecting portion 12*b* of the common electrode 12, the common electrode auxiliary layer 14 is inclined and extends across the edge 11*a* of the glaze layer 11, as shown in FIG. 2. The common electrode auxiliary layer 14 is not constant in thickness, i.e., it has a smaller thickness on the uneven portion 11*c* of the glaze layer 11 than on the other portions.

The overcoat layer 16 is formed to cover the common electrode 12, the heating resistor 13, the common electrode auxiliary layer 14 and the individual electrodes 15. The overcoat layer 16 may be formed of a material mainly composed of glass by a known thick film technique. The protective layer 17 is formed to cover the overcoat layer 16. The protective layer 17 maybe formed by a known thin film technique. As shown in FIG. 2, the overcoat layer 16 does not extend up to the bevel surface 10*c* of the substrate 10 beyond the connecting portion 12*b* of the common electrode 12. On the other hand, the protective layer 17 extends not only onto the upper surface 10*a* but also onto the bevel surface 10*c* and the side surface 10*b* of the substrate 10. As described above, the bevel surface 10*c* is preferably roughened so that the protective layer 17 is firmly attached on the bevel surface 10*c*.

Figure 11:
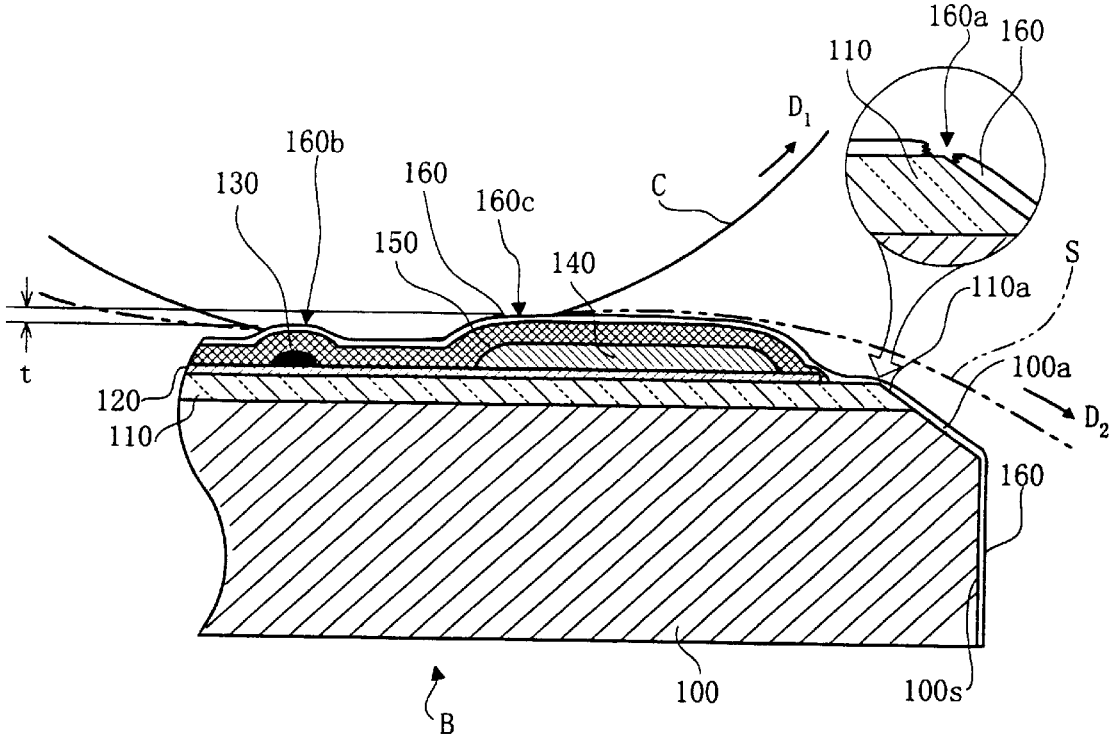
FIG.11 PRIOR ART
FIG. 11 is a sectional view showing a prior art thermal printhead.

In the thermal printhead A according to the present invention, the platen roller C comes into contact with two convex portions of the protective layer 17, i.e., a first convex portion 17*a* (positionally corresponding to the heating resistor 13) and a second convex portion 17*b* (positionally corresponding to the thinner portion of the common electrode auxiliary layer 14), as also is the case in the prior art thermal printhead B (FIG. 11). However, the second convex portion 17*b* of the thermal printhead A does not bulge as much as conventionally is, because the common electrode auxiliary layer 14 laid beneath the second convex portion has a (partially) smaller thickness. As a result, the difference in height (T) between the first convex portion 17*a* and the second convex portion 17*b* is minimal (substantially 0).

With such a structure, it is possible to exert a pressing force of the platen roller C effectively onto the first convex portion 17*a*. Accordingly, the recording paper S is pressed against the first convex portion 17*a* with a sufficient urging force. As a result, heat generated at the heating resistor 13 is effectively transmitted to the recording paper S, thereby providing good printing results.

Next, a method of making the thermal printhead A in accordance with the present invention will be described with reference to FIGS. 3 through 6. As will be understood from the description given below, it possible, according to this method, to obtain a plurality of thermal print heads A from a single mother board.

Figure 3:
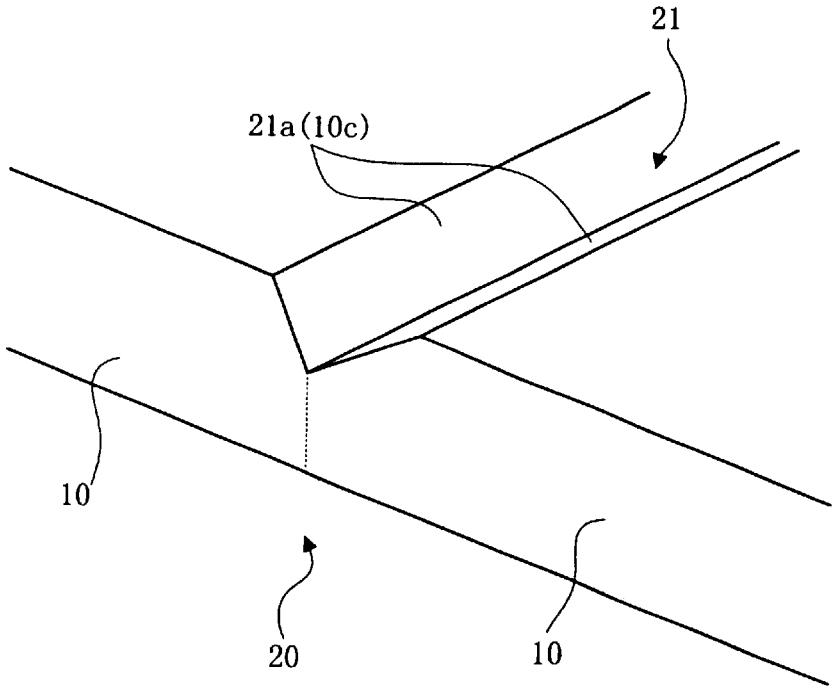
FIGS. 3~6 are perspective views showing an example of method of making a thermal printhead in accordance with the present invention.

First, as shown in FIG. 3, a mother board 20 is prepared on which a groove 21 having a triangular cross section is formed. In this way, bevel surfaces 21*a* are provided on the mother board 20. As will be easily understood, each of the bevel surfaces 21*a* becomes a bevel surface 10*c* of each individual substrate 10 (obtained by dividing the mother board 20). The bevel surface 21*a* is preferably roughened.

Figure 4:
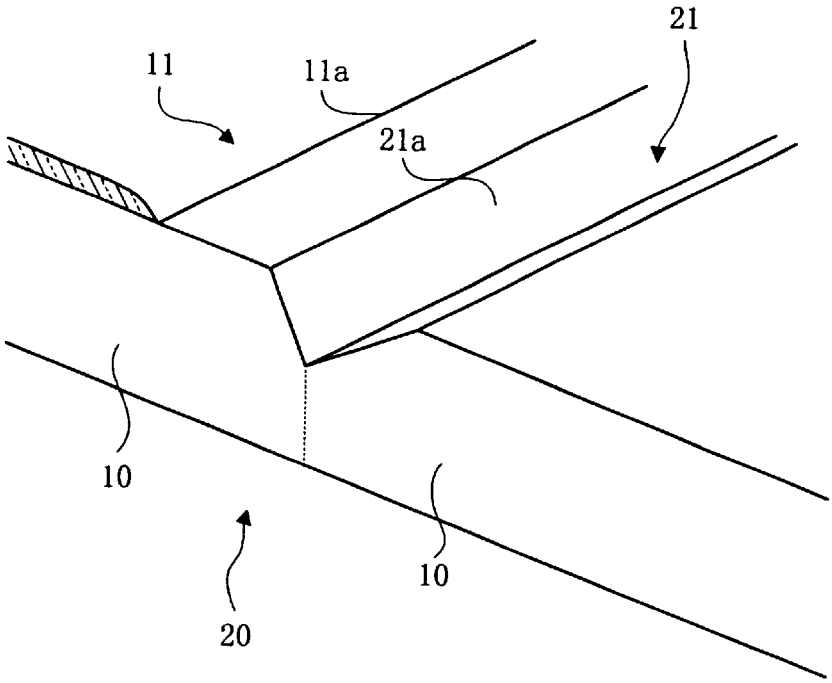

Then, as shown in FIG. 4, a glaze layer 11 is formed so as not to reach the bevel surface 21*a*. The glaze layer 11 has an edge 11*a* spaced from the bevel surface 21*a* by a predetermined distance.

Figure 5:
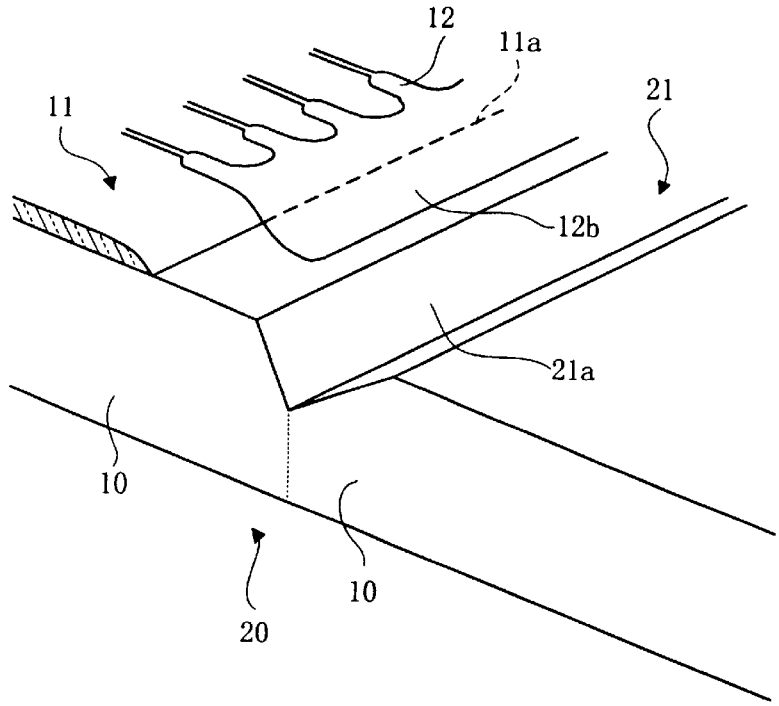

Subsequently, as shown in FIG. 5, a common electrode 12 is formed using photolithography which includes an etching step for example. At this time, though not illustrated in FIG. 5, a plurality of individual electrodes 15 are also formed. The common electrode 12 is formed to have teeth which are entirely located on the glaze layer 11, and a connecting portion 12*b* which is partially located on the glaze layer with the remaining portions located on the upper surface of the mother board 20 (substrate 10). The remaining portions of the connecting portion 12*b* do not reach the bevel surface 21*a*.

Figure 6:
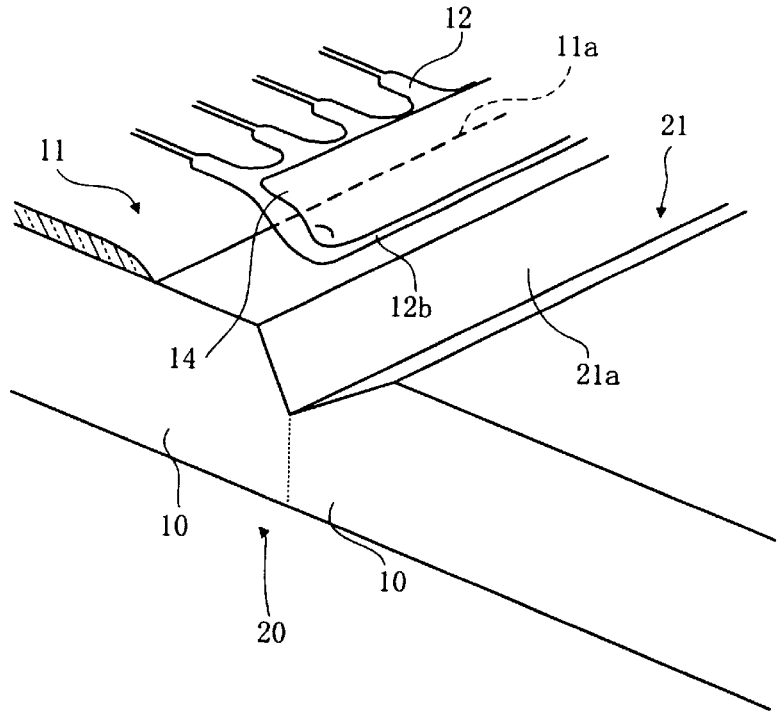

Then, as shown in FIG. 6, an common electrode auxiliary layer 14 is formed on the connecting portion 12*b* of the common electrode 12. The common electrode auxiliary layer 14 also extends across the edge 11*a* of the glaze layer 11. The common electrode auxiliary layer 14 may be formed by applying a conductive paste containing gold, palladium and/or silver and solidifying the paste.

The conductive paste has fluidity before solidification. Accordingly, when the conductive paste is applied onto the common electrode 12 at the connecting portion 12*b* which is smoothly inclined toward the bevel surface 21*a*, the conductive paste tends to move (flow) toward the bevel surface 21*a*, so that the amount of the conductive paste retained on the uneven portion 11*c* (See FIG. 2) of the glaze layer 11 becomes less than the amount of the conductive paste built up between the edge 11*a* of the glaze layer 11 and the bevel surface 21*a*. Thus, upon solidification, the conductive paste (i.e., the common electrode auxiliary layer 14) provides a smaller thickness on the uneven portion 11*c* of the glaze layer 11 and a larger thickness at the remaining portions.

Then, a heating resistor 13 is formed to extend transversely to the teeth 12*a* of the common electrode 12 and the individual electrodes 15 (See FIG. 1). The heating resistor 13 may be formed by applying a paste material having a predetermined resistivity and then solidifying the paste material.

Subsequently, an overcoat layer 16 is formed as a thick film to cover the heating resistor 13 and the common electrode auxiliary layer 14 without reaching the bevel surface 21*a* of the mother board 20 (See FIG. 2).

After the overcoat layer 16 is formed, the mother board 20 is divided into a plurality of individual substrates 10. Then, a protective layer 17 is formed as a thin film on the substrate 10 by spattering for example. As shown in FIG. 2, the protective layer 17 covers not only the overcoat layer 16 but also the bevel surface 10*c* and the side surface 10*b* of the substrate 10.

The method of making the thermal printhead according to the present invention is not limited to the example described above. For example, both the overcoat layer 16 and the protective layer 17 may be formed on the individual substrate 10 after dividing the mother board 20. Further, the overcoat layer 16 may be formed immediately short of the bevel surface 10*c*.

Unlike the prior art thermal printhead B (FIG. 11), in the thermal printhead A obtained through the above process, the protective layer 17 and the glaze layer 11, which are different from each other in thermal expansion coefficient, are not held in contact with each other. Instead, the protective layer 17 is formed directly on the substrate 10 at or near the bevel surface 10*c*. With such a structure, it is possible to reliably prevent the protective cover 17 from being broken (or peeled off) at the bevel surface 10*c* of the substrate 10.

Now, reference is made to FIGS. 7 through 10. Each of these figures is a perspective view showing another method of forming the thermal printhead according to the present invention.

Figure 7:
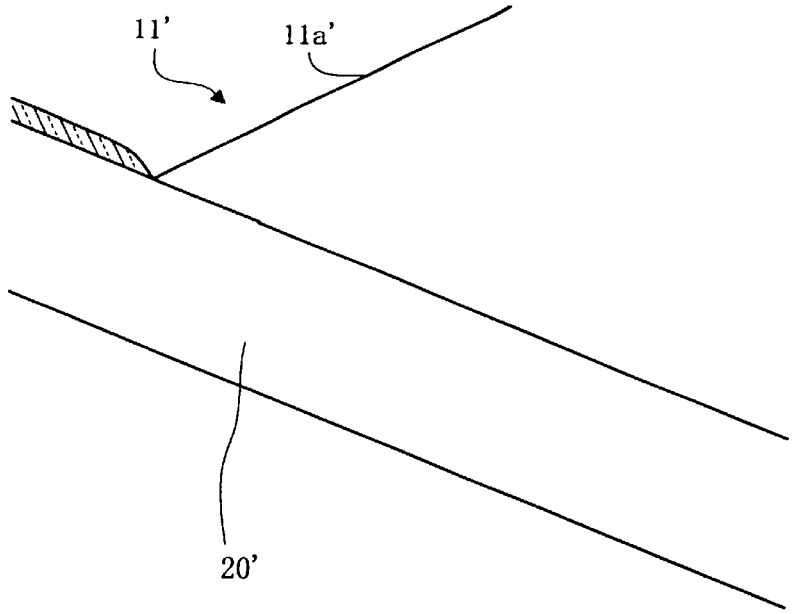
FIGS. 7~10 are perspective views showing another example of method of making the thermal printhead in accordance with the present invention.

First, in this method, an insulating mother board 20' is prepared on which a glaze layer 11' is formed, as shown in FIG. 7. Similarly to the method described above, the glaze layer 11' is formed to have a linearly extending edge 11*a*'.

Figure 8:
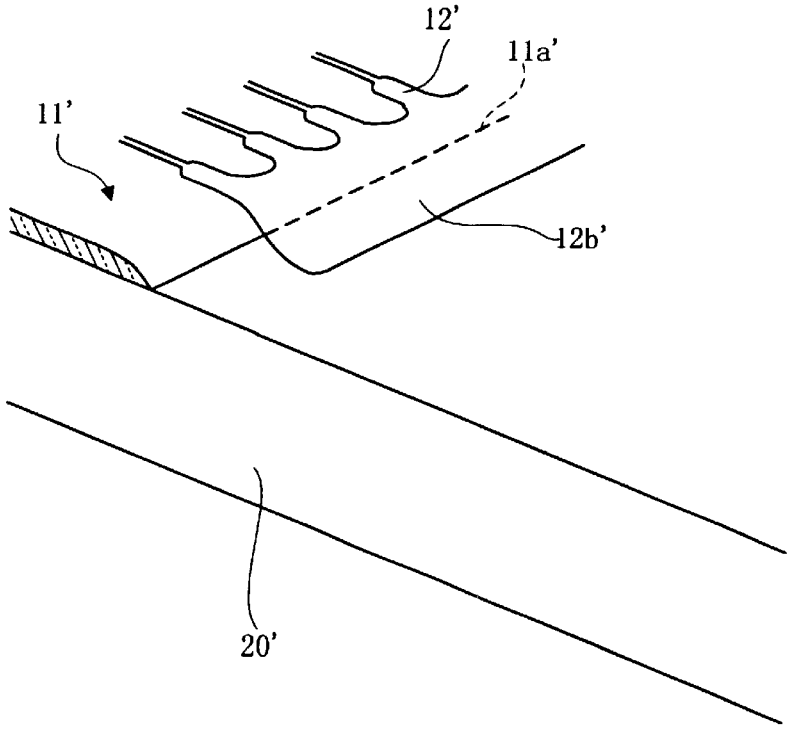

Subsequently, as shown in FIG. 8, a common electrode 12' is formed using photolithography which includes an etching step for example. At this time, though not illustrated in the figure, a plurality of individual electrodes are also formed. The common electrode 12' is formed to have teeth which are entirely located on the glaze layer 11', and a connecting portion 12*b*' which is partially located on the glaze layer 11' with the remaining portions located on the upper surface of the mother board 20'. After the common electrode 12' and the individual electrodes are formed, a heating resistor (not shown) is formed to extend transversely to the teeth of the common electrode 12' and the individual electrodes. However, the heating resistor need not necessarily be formed at this stage. Alternatively, the heating resistor may be formed at the same time as the formation of a common electrode auxiliary layer which will be described below, or after the formation of a common electrode auxiliary layer.

Figure 9:
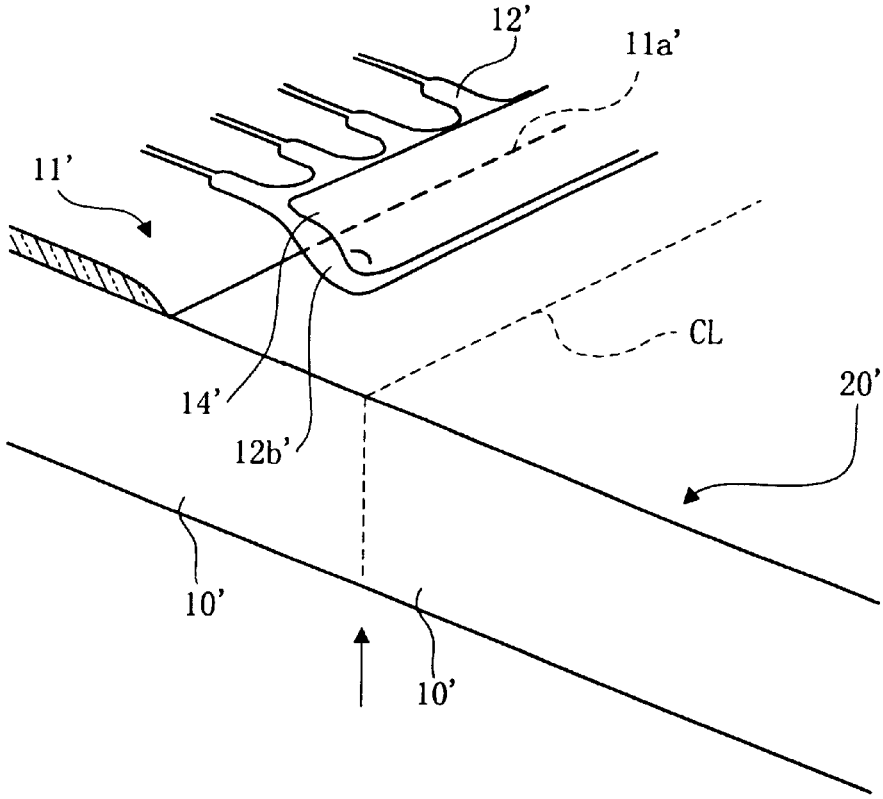
Figure 10:
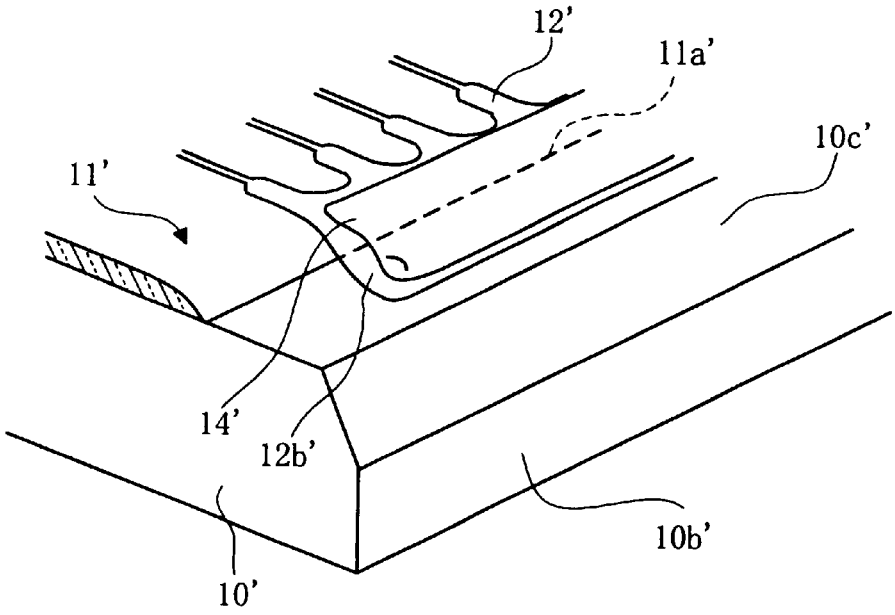

Then, as shown in FIG. 9, an common electrode auxiliary layer 14' is formed on the connecting portion 12*b*' of the common electrode 12'. Similarly to the connecting portion 12*b*' of the common electrode 12', the common electrode auxiliary layer 14' also extends across the edge 11*a*' of the glaze layer 11'.

After the common electrode auxiliary layer 14' is formed, the mother board 20' is divided along a cutting line CL shown in FIG. 9. In this way, a plurality of individual substrates 10' are provided. Though not illustrated, each of the substrates 10' is similarly formed with the glaze layer and the electrode pattern.

The division of the mother board 20' may be performed in the following manner for example. First, as indicated by an arrow in FIG. 9, laser is applied to the mother board 20' from below to form a cutting guide groove on the lower surface of the mother board 20'. Then the mother board 20' is divided by a suitable cutting means along the cutting guide groove. Alternatively, after a cutting guide groove is formed, a bending force may be applied on the mother board 20' to divide the mother board. In such a case, no cutting means is necessary.

Then, the upper corner portion of the substrate 10' is beveled. As a result, a bevel surface 10*c*' is provided which extends between the upper surface and side surface 10*b*' of the substrate 10'. The bevel surface 10*c*' is so formed as to be spaced from the connecting portion 12*b*' of the common electrode 12' by a certain distance.

Finally, an overcoat layer, and a protective layer for covering the overcoat layer are formed (See FIG. 2). The overcoat layer is formed by a thick film technique. The protective layer is so formed as to extend not only onto the upper surface but also continuously onto the bevel surface 10*c*' and the side surface 10*b*' of the substrate 10'. The protective layer may be formed of sialon for example (or a material containing sialon) in the form of a thin film.

What is claimed is:

1. A thermal printhead comprising:

an insulating substrate having an upper surface and a side surface;

a heat retaining glaze layer formed on the upper surface of the substrate;

a heating resistor formed on the glaze layer;

a common electrode including a plurality of teeth connected to the heating resistor, and a connecting portion connecting the teeth with each other;

a plurality of individual electrodes connected to the heating resistor;

an electrode auxiliary layer formed on the connecting portion of the common electrode;

an overcoat layer for covering the heating resistor and the electrode auxiliary layer; and a protective layer for covering the overcoat layer;

wherein the connecting portion of the common electrode includes a first region formed directly on the glaze layer and a second region formed directly on the upper surface of the substrate, the electrode auxiliary layer being arranged to contact both the first and the second regions of the connecting portion.

2. The thermal printhead according to claim 1, wherein the electrode auxiliary layer includes a thinner portion contacting the first region of the connecting portion and a thicker portion contacting the second region of the connecting portion.

3. The thermal printhead according to claim 2, wherein the protective layer includes a first protrusion positionally corresponding to the heating resistor, and a second protrusion positionally corresponding to the thinner portion of the electrode auxiliary layer, the first and the second protrusions being substantially equal in height.

4. The thermal printhead according to claim 1, wherein the glaze layer includes an uneven portion contacting the first region of the connecting portion, the uneven portion being tapered toward the side surface of the substrate.

5. The thermal printhead according to claim 1, wherein the substrate has a bevel surface extending between the upper surface and the side surface of the substrate.

6. The thermal printhead according to claim 5, wherein the glaze layer is spaced from the bevel surface.

7. The thermal printhead according to claim 5, wherein the bevel surface is covered with the protective layer.

8. The thermal printhead according to claim 5, wherein the bevel surface is roughened.

9. A method of making a thermal printhead, the thermal printhead comprising an insulating substrate having an upper surface and a second surface adjoining the upper surface, a heat retaining glaze layer formed on the upper surface of the substrate, a heating resistor formed on the glaze layer, an electrode pattern connected to the heating resistor, an electrode auxiliary layer formed on the electrode pattern, an overcoat layer for covering the heating resistor and the electrode auxiliary layer, and a protective layer formed on the overcoat layer, the method comprising the steps of:

forming the glaze layer to be spaced from the second surface of the substrate;

forming the electrode pattern to have a first region and a second region, the first region being formed directly on the glaze layer, the second region being formed directly on the upper surface of the substrate;

forming the electrode auxiliary layer so as to contact both the first region and the second region of the electrode pattern;

forming the overcoat layer to be spaced from the second surface of the substrate; and forming the protective layer to cover the overcoat layer and the second surface of the substrate.

10. The method according to claim 9, wherein the glaze layer is formed to have an uneven portion tapered toward the second surface of the substrate, the first region of the electrode pattern being formed to contact the uneven portion.

11. The method according to claim 9, wherein the step of forming the electrode auxiliary layer includes applying a fluid conductive paste onto both the first and the second regions of the electrode pattern.

12. The method according to claim 11, wherein the conductive paste is allowed to flow from the first region to the second region.

13. The method according to claim 9, wherein the second surface of the substrate is a bevel surface extending between the upper surface and a side surface of the substrate.

14. The method according to claim 9, further comprising the step of working the substrate to provide a bevel surface.

15. A method of forming a thermal printhead comprising the steps of:

forming a glaze layer on an insulating support;

forming an electrode pattern to have a first region contacting the glaze layer and a second region contacting an upper surface of the support;

forming an electrode auxiliary layer to contact both the first region and the second region of the electrode pattern;

cutting the support at a position spaced from the electrode pattern and the electrode auxiliary layer;

chamfering the support to have a bevel surface which is spaced from the electrode pattern and the electrode auxiliary layer;

forming an overcoat layer for covering the glaze layer, the electrode pattern and the electrode auxiliary layer; and forming a protective layer for covering the overcoat layer and the bevel surface.

16. The method according to claim 15, further comprising the step of applying laser to the support from below to form a cutting guide groove for cutting the support.

17. The method according to claim 15, wherein the protective film is formed of a material containing sialon.

18. A thermal printhead comprising:

an insulating support including an upper surface and a beveled surface adjacent to the upper surface;

a glaze layer formed on the upper surface of the support and spaced from the beveled surface of the support;

an electrode pattern including a first region and a second region continuous with the first region, the first region being directly formed on the glaze layer, the second region being directly formed on the upper surface of the support;

an electrode auxiliary layer contacting both the first and the second regions of the electrode pattern;

an overcoat layer for covering the glaze layer, the electrode pattern and the electrode auxiliary layer; and a protective layer covering the overcoat layer and the beveled surface of the support.

* * * * *